United States Patent [19]

Lambert et al.

[11] Patent Number: 4,564,197

[45] Date of Patent: Jan. 14, 1986

[54] PORTABLE TOY RACING SET

[75] Inventors: Gerard L. Lambert; Michael T. McKittrick, both of Torrance; Hubert A. Rich, Westminster; Gary M. Saffer, Torrance, all of Calif.

[73] Assignee: Mattel, Inc., Hawthorne, Calif.

[21] Appl. No.: 684,405

[22] Filed: Dec. 20, 1984

[51] Int. Cl.[4] ..... A63H 18/14

[52] U.S. Cl. ..... 273/86 D; 446/430

[58] Field of Search ..... 273/86 D, 129 V; 446/429, 430

[56] References Cited

U.S. PATENT DOCUMENTS 3,707,804 1/1973 Cook .

3,998,460 12/1976 Dyer ..... 273/86 D 4,504,242 3/1985 Crain et al. ..... 446/429

FOREIGN PATENT DOCUMENTS 882269 11/1961 United Kingdom ..... 273/86 D

*Primary Examiner*—Anton O. Oechsle

*Attorney, Agent, or Firm*—Ronald M. Goldman; Melvin A. Klein

[57] ABSTRACT

A portable toy racing set is disclosed which includes a booster for accelerating toy vehicles around a curved track. The booster includes an arm which pivots about an axis perpendicular to the track and offset from the center of a curved portion of the track. A finger depends from the arm and travels from a position adjacent the side of the track to a position which causes it to contact the vehicle.

7 Claims, 9 Drawing Figures

PORTABLE TOY RACING SET

BACKGROUND OF THE INVENTION

This invention relates to toys and, more particularly, to toy racing sets in which vehicles are raced around closed courses, or tracks.

Many toy racing sets have been devised over the years. Some of the sets are designed for use with self-propelled vehicles, while others are used with inertia or gravity propelled vehicles. In those instances where inertia driven vehicles are employed, the racing sets generally employ spring-loaded starting mechanisms to accelerate the vehicle. One type of starting mechanism pushes the vehicle onto the track, while another type accelerates the wheels of the vehicle before it enters the track.

In addition to the starting mechanisms described above, it is desirable to provide a mechanism which can re-accelerate or boost the speed of the car while it is travelling around the track. Such boosters generally employ mechanisms which accelerate the vehicle wheels as opposed to pushing the vehicle along the track.

In general, wheel accelerating mechanisms, as contrasted to push-type staring mechanisms, require a large number of components for their construction, as well as a rotary source of mechanical energy.

Accordingly, it is an object of the present invention to provide a new and improved toy racing set.

It is another object of the present invention to provide a toy racing set capable of boosting the speed of a toy vehicle while it is in motion.

It is yet another object of the present invention to provide apparatus for boosting the speed of a moving toy vehicle by pushing the vehicle along its track.

SUMMARY OF THE INVENTION

The foregoing and other objects of the invention are accomplished by a toy racing set which includes a track for containing a toy vehicle. A portion of the track is shaped to provide a generally U-shaped curve.

A booster is provided for accelerating the vehicle on the track when the vehicle is either moving or stationary. The booster includes an arm which extends over the track at a height which is above that of the vehicle. The arm is pivotably mounted about an axis which is substantially perpendicular to the track. The axis is offset from the center of the U-shaped curved portion of the track so that the arm pivoting motion is eccentric with respect to the track.

A finger is provided which depends from the arm a distance sufficient to contact the vehicle traveling on the track. A spring accelerates the arm about the axis from a first position where the finger is adjacent one side of the track at a point which is clear of the path of the vehicle to a second position where the finger is in the path of the vehicle. By causing the spring to accelerate the arm just after the vehicle has passed the first position, the finger contacts the vehicle and accelerates it as it is moving on the track.

Other objects, features and advantages of the invention will become apparent from a reading of the specification when taken in conjunction with the drawings in which like reference numerals refer to like elements throughout the several views.

DESCRIPTION OF THE PREFERRED EMBODIMENT

Figure 1:
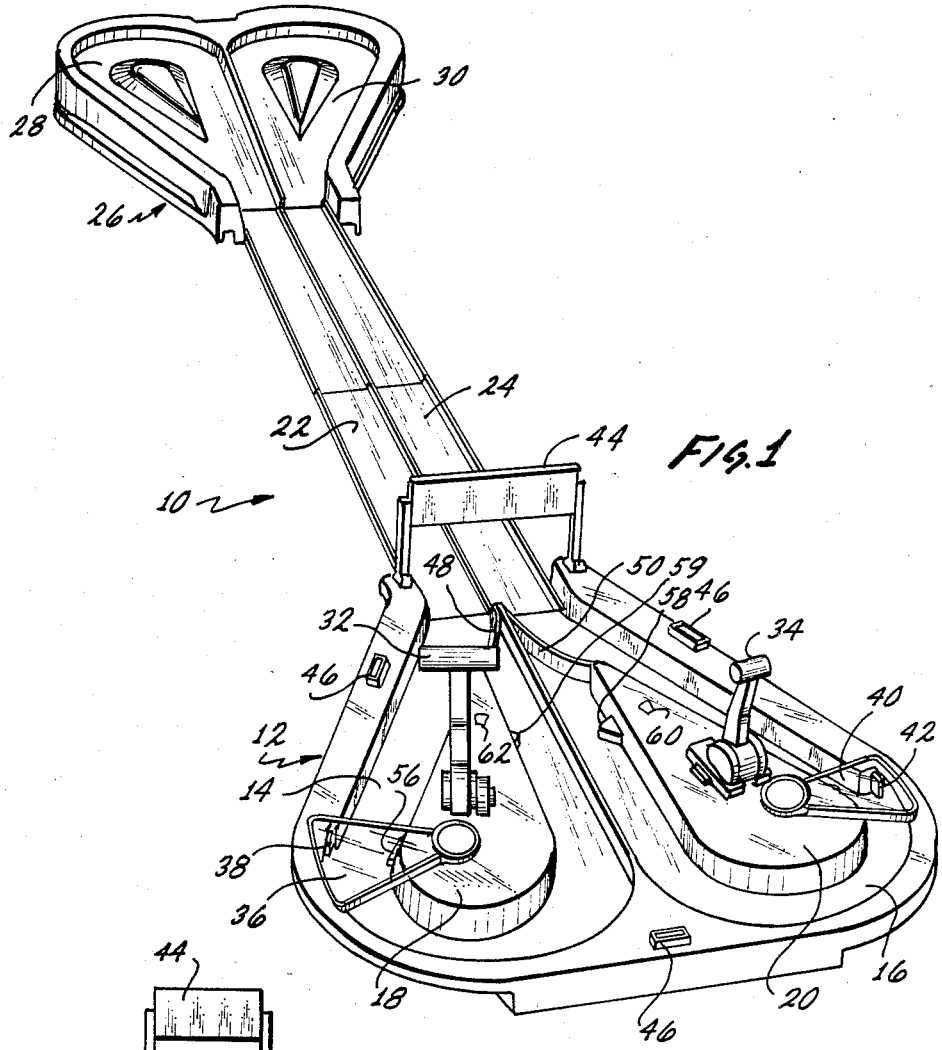
FIG. 1 is a perspective view of a toy racing set constructed in accordance with the present invention and showing two race tracks for toy vehicles.

Referring to FIG. 1, there is shown a perspective view of a toy racing set 10 constructed in accordance with the teachings of the present invention. The set 10 includes a booster section 12 which includes two track sections 14 and 16, each in the form of a hairpin U-turn. Mounted in the central sections of each of the tracks 14 and 16 are booster mechanisms 18 and 20, respectively, which are used to accelerate toy vehicles on the tracks 14 and 16 in the manner described below.

Attached to the mouth of each of the U-turn sections 14 and 16 are straight track sections 22 and 24, respectively. The track sections 22 and 24 are in turn attached to an open end of a turnaround portion 26 of the set 10. The turnaround portion 26 includes two side by side hairpin U-turn tracks 28 and 30. The overall shape of the portion 26 is substantially similar to the overall shape of the portion 12. It will be seen from FIG. 1 that the sections 12 and 26 in conjunction with the tracks 22 and 24 form two closed loop tracks which may be used for racing toy vehicles.

The boosters 18 and 20 each include a handle 32, 34 used to operate the respective booster. Referring to the booster 18, an arm 36 extends from the booster 18 over the track 14 at a height which permits a toy vehicle to pass under the arm 36 without contacting it. A finger 38 depends from the arm 36 a distance sufficient to contact the toy vehicle when it is traveling on the track. By operating the lever 32, a user is able to wind a spring within the booster 18 which biases the arm 36 in the position shown in FIG. 1, referred to hereinafter as the first or cocked position. It will be seen that in this position the finger 38 is located adjacent an outer wall of the track 14 and is not in the path of a vehicle traveling on the track 14.

The lever 32 is also used to lock the arm 36 in the first position as well as to release the arm 36 when a toy vehicle is at an appropriate point around the curved portion of the track 14. When the arm 36 is released it swings around the curve in an eccentric manner. This is so because the arm 36 is pivoted about an axis which is offset from the center of the curve 14. The eccentric motion causes the finger 38 to move from the first position adjacent the side of the track 14 to a second position within the path of a car on track 14. By appropriately timing the release of the arm 36 relative to the position of a toy vehicle, the finger 38 may be used to push against the rear of the toy vehicle and reaccelerate it around the track. The arm 36, which may be constructed of a clear plastic to show the operation of the booster 18, acts to prevent the toy vehicle from lifting up off the track 14 during the boosting operation.

The operation of the booster 20 is substantially identical to the operation of the booster 18. A lever 34 is used to control the motion of arm 40 from which depends a finger 42. The motion of the arm 40 is used to boost a toy vehicle around the track 16.

Figure 2:
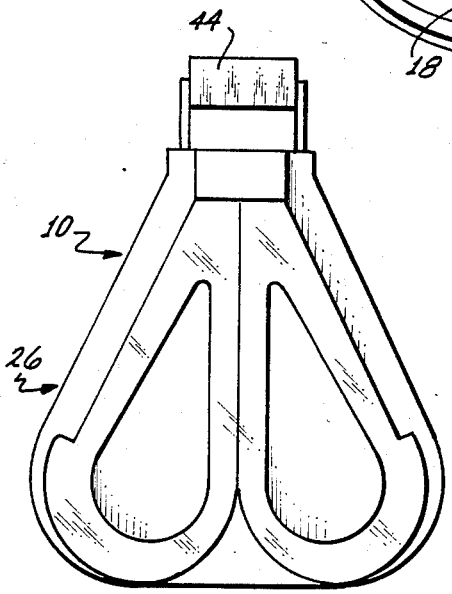
FIG. 2 is a side view showing the toy racing set of FIG. 1 folded together for storage or carrying.

The unique construction of the toy race set 10 permits it to be disassembled and reconfigured into a storage and carrying case as shown in FIG. 2. The set 10 is disassembled as follows. The plug-in track sections 22 and 24 are removed from the ends of the sections 12 and 26. The handles 32 and 34 are lowered so that they lie flat on top of the housings of the boosters 18 and 20. With the track sections 22 and 24 detached, a generally U-shaped plastic element 44, normally used as a sign over the finish/start line of the set 10, is folded to a position parallel with the section 12. The track sections 22 and 24 are laid on top of the flat handles 32 and 34. The section 26 is then placed over the similarly shaped section 12. The section 12 is equipped with projections 46 which engage within openings provided in the bottom of the section 26. In this manner the sections 26 and 12 are sandwiched together to form a carrying case and the element 44 serves as a carrying handle.

Figures 3, 8:
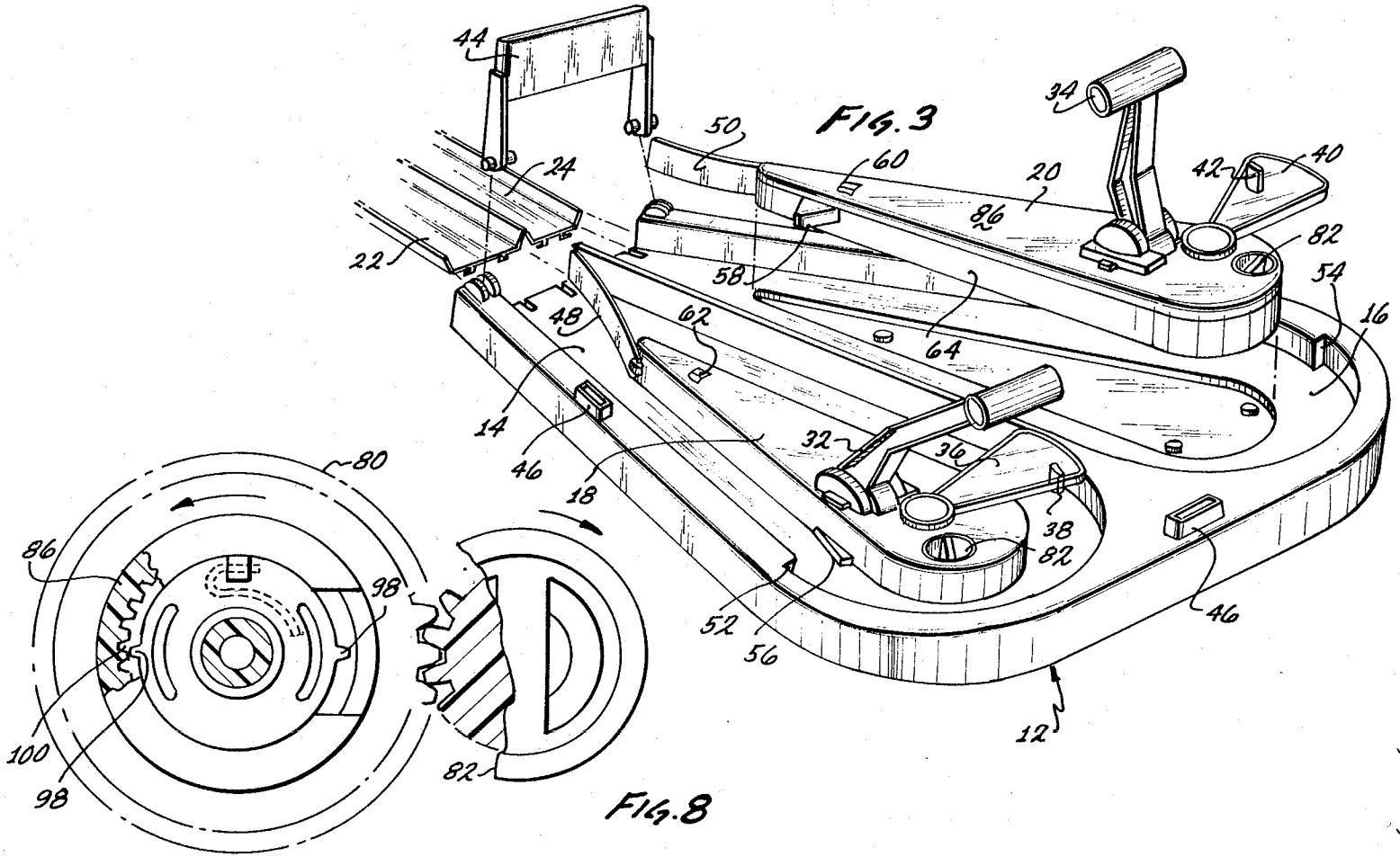
FIG. 3 is an exploded perspective view of a portion of the toy racing set of FIG. 1 containing booster mechanisms for accelerating the toy vehicles.
FIG. 8 is a cross-sectional view of a tension adjustment portion of the booster of FIG. 4, taken along the line 8—8 of FIG. 5.

FIG. 3 is an exploded perspective view of the section 12 showing the assembly of the various elements. The boosters 18 and 20 are assembled in housings made of a suitable material such as plastic. The housings are then fastened to the bottom of the section 12 and form the inner wall of the tracks 14 and 16, respectively. The track sections 22 and 24 plug into the open end of the section 12 using, for example, tongue and groove elements well known to those skilled in the art. It is worth noting that the sections 12 and 26 can be plugged directly together without using the track sections 22 and 24. In this way a shorter track layout may be constructed for use in a limited play area.

The handle 44 snaps into openings provided in the section 12. Locking detents are provided so that the handle 44 may latch into an upright position on may latch into a flat position for use as a handle. Spring loaded barriers 48 and 50 are pivotably fastened to one end of the boosters 18 and 20, respectively. The barriers 48 and 50 act as diverters for the toy vehicles racing around the track set 10. For example, the diverter 48 is biased in the position shown in FIG. 3 so that a toy vehicle entering the curved portion of the track 14 is forced to the outer portion of the curve. As the vehicle rounds the curve and exits, the spring loaded diverter 48 gives way so that the vehicle may exit the section 12 and proceed in reverse direction along the track section 22. The barrier 50 acts in a similar manner to properly divert the toy vehicle traveling on the track section 24 and the track 16.

The outer walls of the tracks 14 and 16 are each provided with a notch 52 and 54, respectively. The notch 52 cooperates with the finger 38 to hold the arm 36 in its cocked position. In a similar fashion the notch 54 cooperates with the finger 42 to limit the pivoting motion of the arm 40 and to thus maintain it in its cocked position. The booster 18 is equipped with a spring loaded tab 56 mounted opposite the notch 52. The spring loaded tab 56 acts to guide the toy vehicle toward the outer wall of the curved portion of the track 14 to insure smooth negotiation of that curve. The booster 20 is similarly equipped with a spring loaded tab (not shown) used for guiding the vehicle around the track 16.

Another spring loaded tab 58 is provided on the booster 20 at a position where the toy vehicle exits the curved portion of the track 16. The tab 58 is used to actuate a lap counter which provides an indication of the number of laps the vehicle has traversed. The lap counter indication appears at a window 60 provided in the top of the booster 20. In similar fashion, the booster 18 also includes a tab 59 for activating a lap counter. The number of laps traversed by the vehicle on the track 14 is indicated in window 62.

Figure 4:
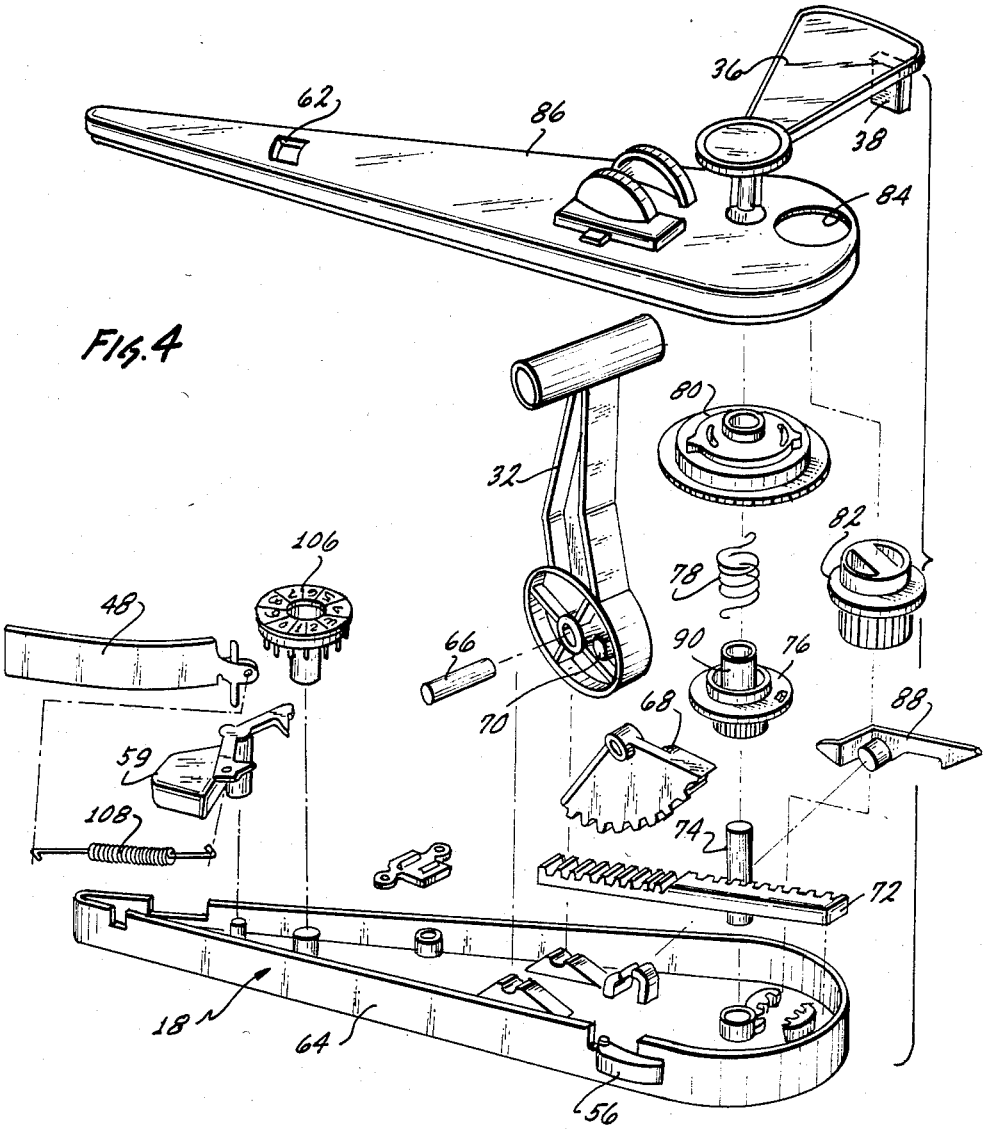
FIG. 4 is an exploded perspective view of one of the booster mechanisms of FIG. 3.
Figure 5:
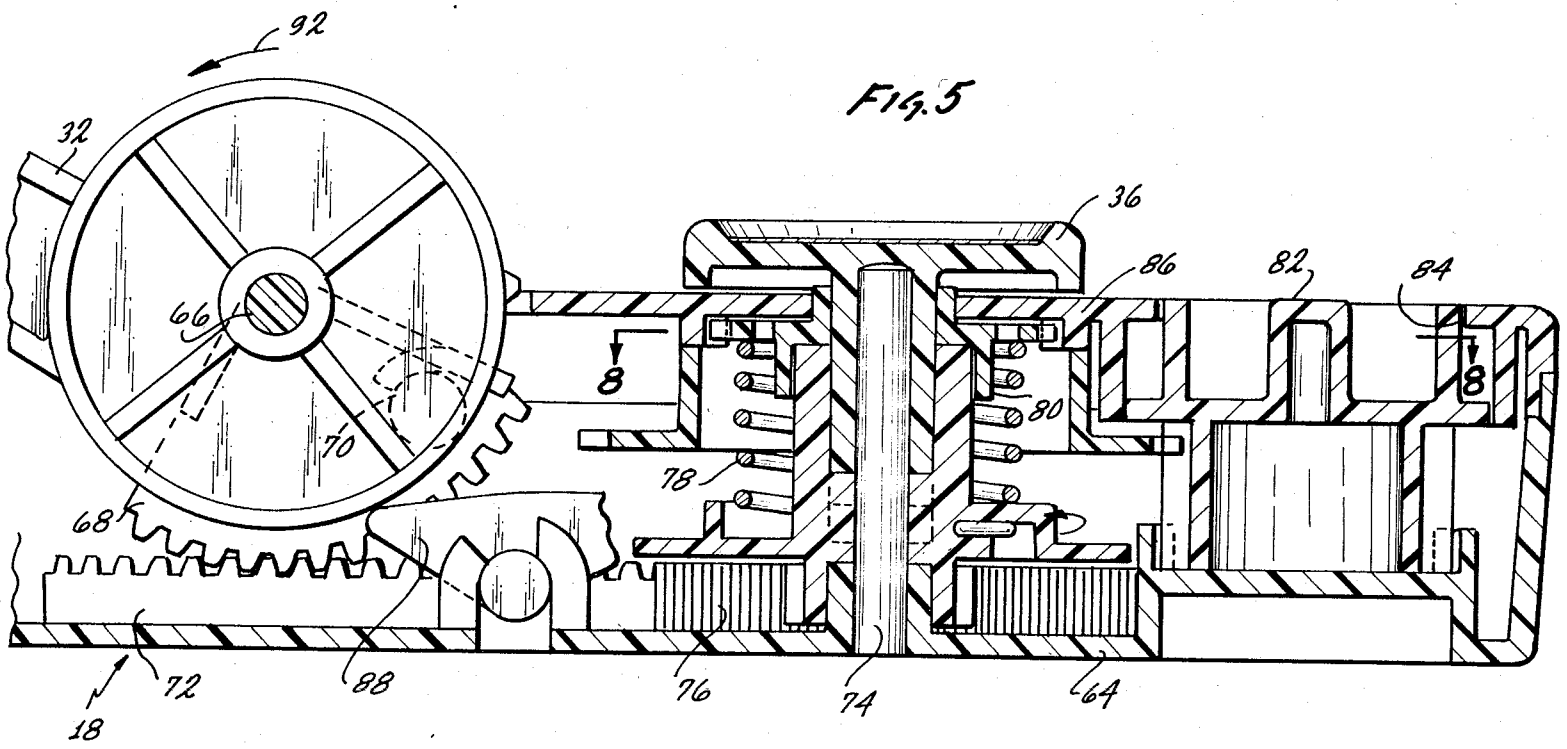
FIG. 5 is a cross-sectional view of a portion of the booster mechanism of FIG. 4 showing the position of the elements when the booster is being cocked.

FIG. 4 is an exploded perspective view of the booster 18, and FIG. 5 is a cross sectional view of a portion of the assembled booster 18. Referring to these two figures, the handle 32 is pivotably mounted to a bottom housing 64 of the booster 18 using an axle 66. The axle 66 also mounts a sectional gear 68 which is mechanically coupled to the handle 32 in a lost motion manner via pin 70 which projects from the handle 32. A vertical shaft 74 rotatably supports a geared sleeve 76 to which is attached one end of a spring 78. The other end of the spring 78 is fastened to a geared sleeve 80. The arm 36 mounts through an opening in the sleeve 80 and attaches to the sleeve 76. A geared knob 82 is linked to the sleeve 80 and extends through an opening 84 in a top housing 86. The motion of the gear 68 is coupled to the gear 76 using rack 72. A lever 88 cooperates with a detent 90 in the sleeve 76 to hold the spring 78 in a wound position as described below.

Figure 6:
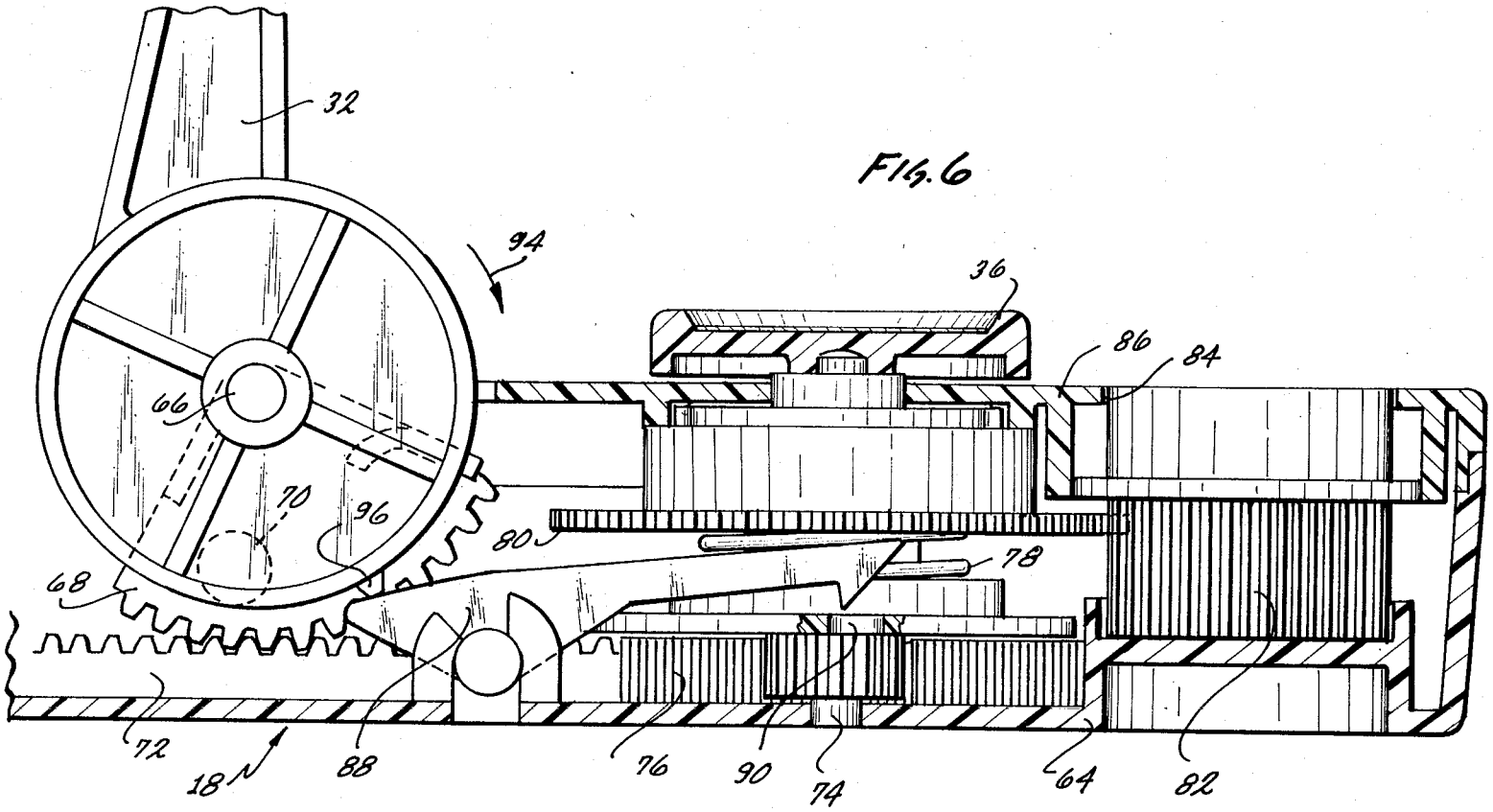
FIG. 6 is a cross-sectional view of a portion of the booster mechanism of FIG. 4 showing the position of the elements when the booster is being fired.

Referring to FIGS. 5 and 6, the operation of the booster 18 is as follows. When the handle 32 is moved in the direction of arrow 92, the pin 70 engages the gear 68. The gear 68 in turn moves rack 72. Rack 72 is coupled to geared sleeve 76 causing it to rotate. Rotation of gear 76 causes the arm 36 to pivot to the cocked position as well as to cause the spring 80 to be wound tightly. The handle 32 continues to be moved in direction 92 until the arm 36 has moved to the cocked position. At this point, as shown in FIG. 6, lever 88 engages within detent 90 thus holding the sleeve 76 and preventing the spring 78 from unwinding.

When the handle 32 is moved in the direction of arrow 94 as shown in FIG. 6, a projection 96 extending from the handle 32 presses down on one end of the lever 88 and causes the opposite end to disengage from the detent 90. At this point the sleeve 76 is released and the spring 78 causes the arm 36 to pivot rapidly around the curved section of the track 14 to boost the vehicle. The booster 18 may be re-cocked by moving the handle back in the direction 92 and repeating the steps described above.

The tension exerted by the spring 78 when the booster 18 is in the cocked position may be adjusted by rotating the knob 82 in the following manner. Referring to FIG. 8, the geared portion of the knob 82 is coupled to the geared portion of the sleeve 80 which retains the upper end of the spring 78. The sleeve 80 includes teeth 98 which engage within detents 100 provided in the upper housing 86. By rotating the knob 82 the sleeve 80 may be turned so that the teeth 98 engage in various of the openings 100. When the knob 82 is released, the sleeve 80 is locked into position relative to the housing 86. The position of the sleeve 80 determines the degree to which the spring 78 is wound when the handle 32 is moved in the direction 92. In this manner the amount of force exerted by the arm 36 when it contacts a toy vehicle may be adjusted to a level compatible with the size and weight of that particular toy vehicle.

Figure 7:
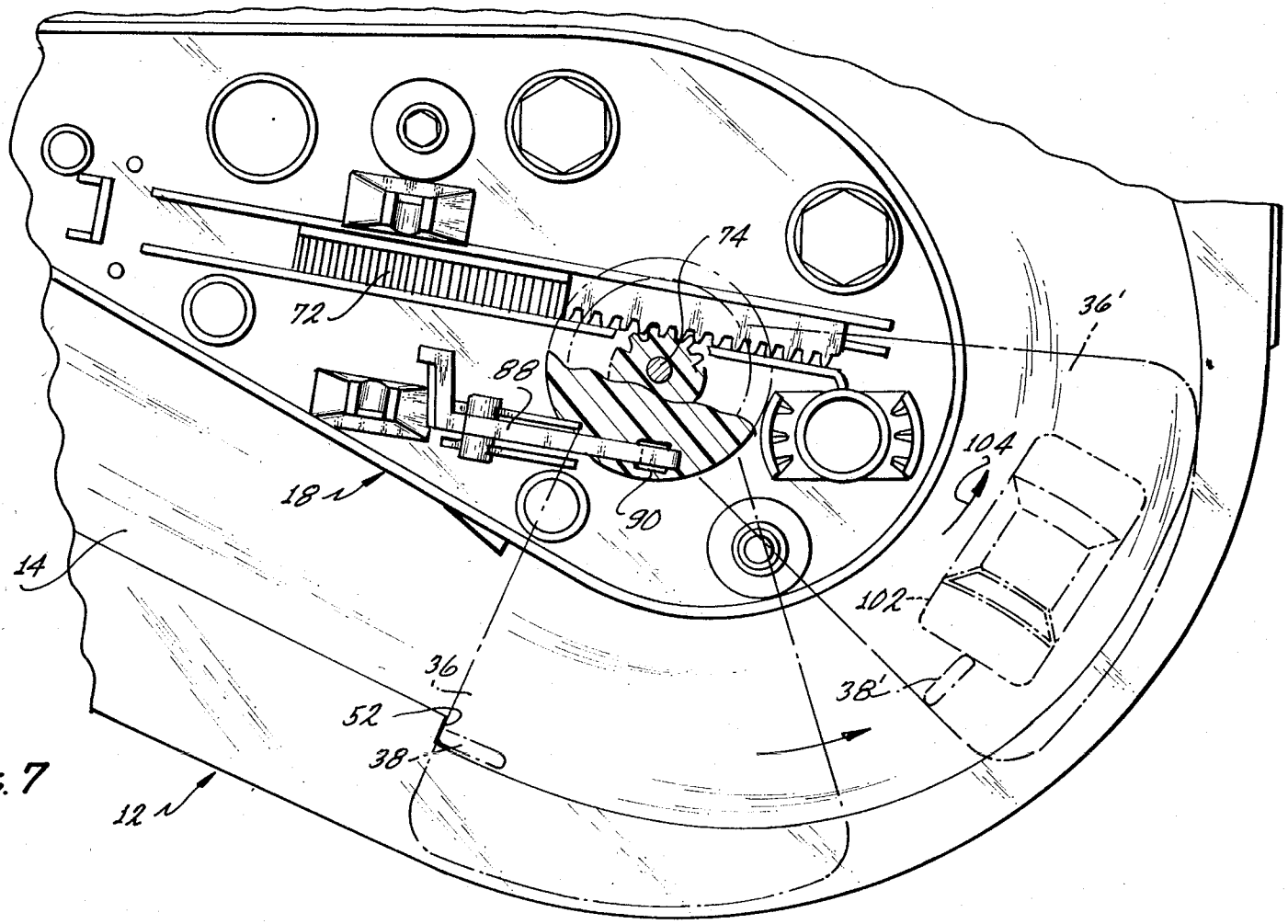
FIG. 7 is a top view of a portion of the booster, partially cut away, showing the position of the booster arm before and during the boosting of a toy vehicle.

FIG. 7 shows the operation of the booster 18 with a toy vehicle proceeding around the track 14. With the booster 18 in the cocked position, the arm 36 is in the position shown by the solid lines where the finger 38 rests against one wall of the notch 52. As a toy vehicle 102 proceeds around the track 14 in the direction of arrow 104 and passes the finger 38 the handle 32 is moved in the direction 94, thereby releasing the arm 36. Due to the eccentric mounting of the arm 36 with respect to the track 14, the finger 38 moves from a position adjacent the outer wall of the track 14 to a position approximately in the center of the track 14. This position is shown as 38′ in FIG. 7. It may be seen that the finger in position 38′ contacts the rear of the vehicle 102 and quickly boosts the speed of the vehicle around the curve 14. The amount of boost is proportional to the spring tension as set by the knob 82.

Figure 9:
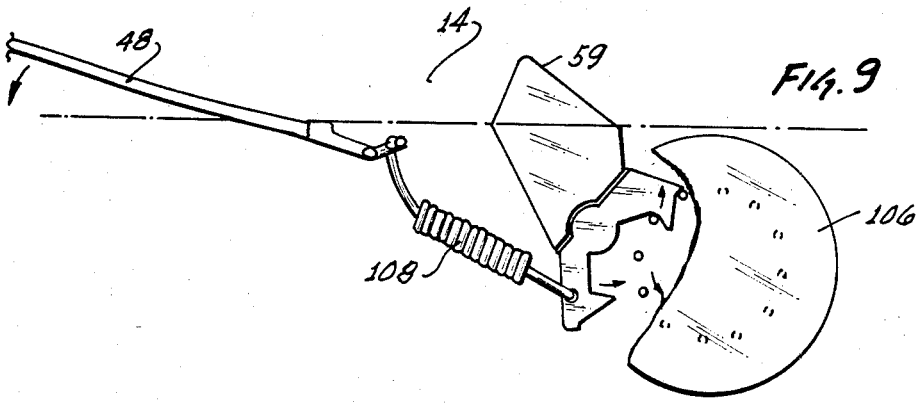
FIG. 9 is a top view, partally cut away, of a portion of the interior of the booster of FIG. 4, showing the construction of the lap counter.

As the vehicle 102 rounds the curve 14 it depresses the lap counter tab 59 which causes the lap counter to advance in the manner shown in FIG. 9. The tab 59 acts as a ratchet to advance a wheel 106 having counter indicia on its upper face. The ratchet action is accomplished using a spring 108 coupled between the tab 59 and one end of the diverter 48. Accordingly the spring 108 provides two functions. It biases the diverter 48 as well as the ratchet of the tab 59.

The booster 20 operates in an identical fashion to the booster 18 described above. Accordingly, two users of the game may race toy vehicles on the set 10 with the winner being the user that is able to first complete a predetermined number of laps. The boosters 18 and 20 are used to both start the vehicles around the track as well as to maintain the speed of the vehicles for every succeeding lap. It will be appreciated that the skill of the users in timing the operation of the handles 32 and 34 will determine the outcome of the race.

While there has been shown and described a preferred embodiment of the invention it is to be understood that various other adaptations and modifications may be made within the spirit and scope of the invention. It is thus intended that the invention be limited in scope only by the appended claims.

What is claimed is:

1. A toy racing set, comprising:

a track for containing a toy vehicle, including a generally U-shaped curved portion; and booster means for accelerating the vehicle on the track, including an arm which extends over the track at a height which is above that of the vehicle and which is pivotably mounted about an axis substantially perpendicular to the track, the axis being offset from the center of the U-shaped curved portion of the track so that the arm pivoting motion is eccentric with respect to the track, a finger which depends from the arm a distance sufficient to contact the vehicle traveling on the track, means for accelerating the arm about the axis from a first position where the finger is adjacent one side of the track at a point which is clear of the path of the vehicle to a second position where the finger is in the path of the vehicle, whereby by accelerating the arm just after the vehicle has passed the first position, the finger contacts the vehicle and accelerates it as it is moving on the track.

2. The toy of claim 1 in which the arm is made sufficiently large in area to cover a substantial portion of the vehicle when it is being boosted, thereby preventing the vehicle from lifting off the track during the boost.

3. The toy of claim 1 in which the means for accelerating the arm includes a spring which forces the arm to the second positon; and a user-operated control used to oppose the spring force to move the arm to the first position, to lock the arm in the first position, and to release the arm.

4. The toy of claim 3 further including a second user operated control used to adjust the spring force.

5. The toy of claim 1 further including:

a second track for containing a second toy vehicle, the second track including a generally U-shaped curved portion; and a second booster means substantially identical to the first booster means for accelerating the second toy vehicle on the second track.

6. The toy of claim 1 in which the track includes a second U-shaped curved portion shaped substantially identical to the first U-shaped portion, and means for removably engaging the two track portions to create a closed loop track.

7. The toy of claim 6 further including means for fastening the disengaged second track portion on top of the first track portion whereby the shapes of each track section are substantially aligned one above the other to form a carrying case for the toy.

* * * * *